US005419232A

United States Patent [19]

Curtis

[11] Patent Number: 5,419,232

[45] Date of Patent: May 30, 1995

[54] ELASTOMERIC SHUTTER MECHANISM

[75] Inventor: Clifford M. Curtis, Portsmouth, R.I.

[73] Assignee: The United States of America as represented by the Secretary of the Navy, Washington, D.C.

[21] Appl. No.: 215,795

[22] Filed: Mar. 22, 1994

[51] Int. Cl.[6] ..... B63G 8/28

[52] U.S. Cl. ..... 89/1.81; 114/320

[58] Field of Search ..... 89/1.809, 1.810; 114/320, 325, 116, 201 A, 238

[56] References Cited

U.S. PATENT DOCUMENTS

| | | | |
|---|---|---|---|
| 491,051 | 1/1893 | Holland | 114/320 |
| 958,650 | 5/1910 | Kimbrell | 114/320 |
| 1,310,880 | 7/1919 | Schneider | 114/320 |
| 1,393,601 | 10/1921 | Barraja-Frauenfelder | 114/320 |
| 1,842,572 | 1/1932 | Strauss | 114/325 |
| 4,848,210 | 7/1989 | Bissonnette | 89/1.810 |

*Primary Examiner*—David Brown
*Attorney, Agent, or Firm*—Michael J. McGowan; Prithvi C. Lall; James M. Kasischke

[57] ABSTRACT

An elastomeric shutter mechanism for opening and closing a passageway in the wall of a vessel, such as a submarine hull. A single, unitary, retractable shutter member made of an elastomeric material is partially attached to the wall around a portion of a passageway. The single, unitary, retractable shutter member is moveable from a closed position when the unattached portion of the shutter member is abutting the wall around the passageway to an open position when the unattached portion of the shutter member is retracted away from the wall around the passageway. Cables are attached to the inside surface of the shutter member for retracting the shutter member and opening the passageway. Mechanical stops are positioned inside of the vessel for abutting the shutter member when retracted to the open position by the cables. On an underwater vessel such as a submarine, the shutter member is sealed in the closed position by a pressure differential between the inside surface and the outside surface of the shutter member or latched in place in the closed position. Split ribs are included on the inside surface of the shutter member to resist the expansion of the shutter member when maintained in the closed position by the pressure differential.

11 Claims, 3 Drawing Sheets

ELASTOMERIC SHUTTER MECHANISM

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field Of The Invention

This invention relates to a mechanism for the opening and closing of a passageway in the hull of a submarine vehicle and in particular, to an elastomeric shutter mechanism.

(2) Description of the Prior Art

Closable openings are necessary in the hull of a submarine vessel for the ejection of weapons, Unmanned Undersea Vehicles (UUV), countermeasures, waste and water and for the ingestion of water and (UUV) into the submarine. Typically, the openings on submarine hulls have steel doors and opening mechanisms to allow for ejection and ingestion to and from the submarine hull. One example of a prior art opening mechanism in a submarine hull is a torpedo launchway shutter door and ejection pump sea chest inlet.

However, such prior art opening mechanisms have many disadvantages. Firstly, the mechanism which operates the steel doors is expensive to fabricate. Secondly, the installation and maintenance of the door and opening mechanism is expensive. Thirdly, the prior art mechanism causes excessive noise because of fluid flow through gaps around the openings and rattles caused by the mechanical parts of the mechanism.

Other prior art closure mechanisms for missiles and rockets include frangible diaphragms or covers which can be made of plastic or an elastomeric material are disclosed in U.S. Pat. Nos. 3,135,163; 3,279,319; 4,301,708; 4,498,368 and 5,062,345. Such frangible closures, however, are not a feasible alternative because they are destroyed upon launching the projectile or missile.

Accordingly, what is needed is a shutter mechanism which is made from a molded elastomeric material and which can be fabricated and installed at a lower cost than the prior art steel door mechanism. Such an elastomeric shutter mechanism must be able to be sealed closed and have a simple retraction mechanism to eliminate rattles and excessive noise. Finally, the elastomeric shutter mechanism must be able to be used repeatedly and return to its original form when closed.

SUMMARY OF THE INVENTION

The present invention is directed to a flexible shutter mechanism for opening and closing a passageway in the wall of a vessel, such as a submarine hull. The shutter mechanism includes a single, unitary, retractable shutter member made of an elastomeric material having an inside surface and an outside surface. The elastomeric material is preferably made from a material such as natural rubber, synthetic rubber, neoprene or polyurethane. The shutter member is attached to the wall around a substantial portion of the passageway, thus leaving a portion of the shutter member which is not attached to the wall. The single, unitary, retractable shutter member is in a closed position when the unattached portion of the shutter member is abutting the portion of the wall around the passageway, opposite from the unattached portion of the shutter member. The single, unitary, retractable shutter member is in an open position when the unattached portion of the shutter member is retracted away from the portion of the wall around the passageway opposite from the portion of the shutter member.

In a preferred embodiment, the single, unitary, retractable shutter member has a substantially polygonal shape with three or more sides, such as a rectangle. One of the sides acts as the unattached portion which can be retracted away from the wall while the remaining sides are attached to the wall around the opening.

The flexible shutter mechanism further includes a retraction mechanism attached to the inside surface of the retractable shutter member. The retractable shutter member remains in the closed position until the retraction mechanism retracts the shutter member into its open position.

In the preferred embodiment, the retraction mechanism includes a cable retraction system for retracting the shutter member. The cable retraction system comprises at least one cable attached to the inside surface of the retractable shutter member and at least one mechanical stop mounted inside of the vessel. A force is applied to the cable to retract the shutter member until the shutter member abuts the mechanical stop and is in the open position. In another embodiment, the retraction mechanism may include a mechanical linkage system. The unitary member will return to its closed position by internal elastic forces when the retraction mechanism is released.

When used on an underwater vessel such as a submarine hull, the single, unitary, retractable shutter member is subject to hydrodynamic forces which could cause it to distort from its faired alignment with the hull. This distortion can be eliminated or reduced by latching the unattached portion of the unitary retractable member, latching the unitary member material frame, or molding the unitary retractable member into a geometry which will resist such distortion.

In the preferred embodiment, a plurality of split ribs are provided on the inside surface of the single, unitary, retractable shutter member for resisting the expansion of the shutter member when in the closed position. When retracted the unitary member will return to its closed position by internal elastic forces when the retraction mechanism is released.

BRIEF DESCRIPTION OF THE DRAWINGS

These, and other features and advantages of the present invention will be better understood in view of the following detailed description of the invention, taken together with the drawings wherein.

DESCRIPTION OF THE PREFERRED EMBODIMENT

Figure 1A:
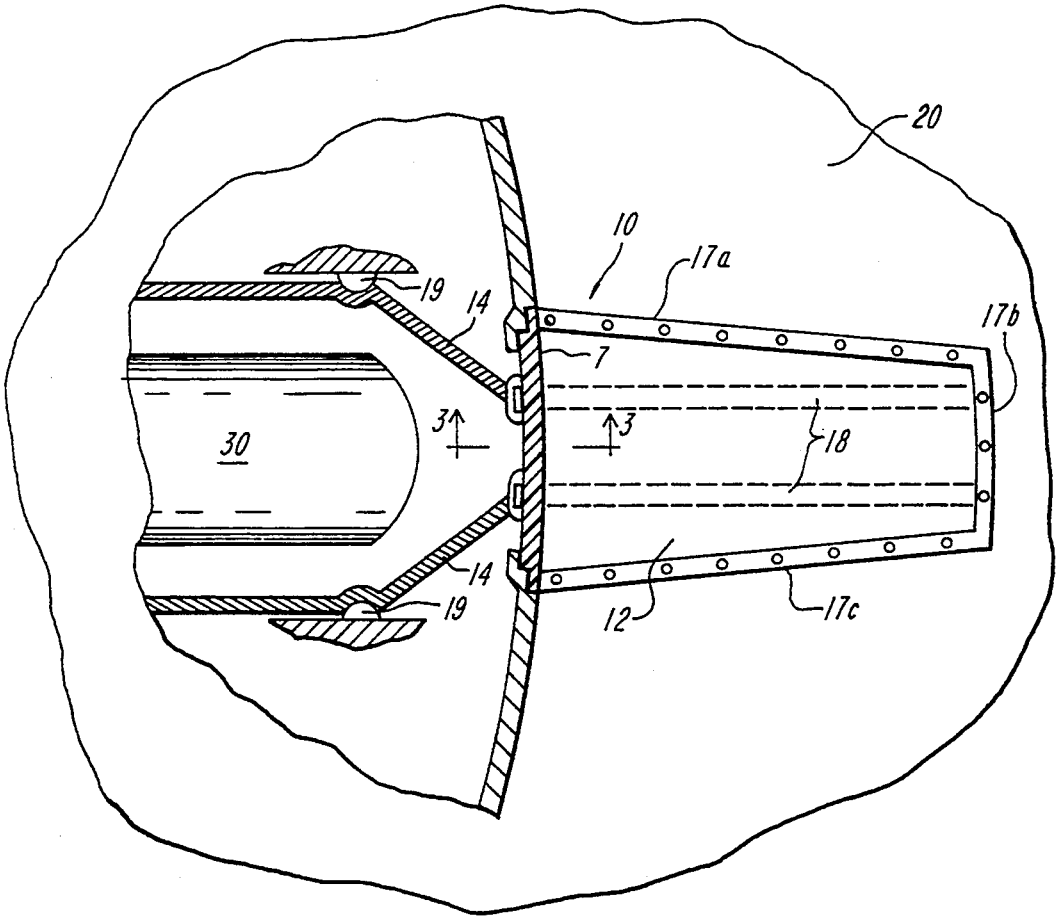
FIG. 1A is a cut-away side view of a submarine hull having an elastomeric shutter mechanism according to the present invention in a closed position.
Figure 1B:
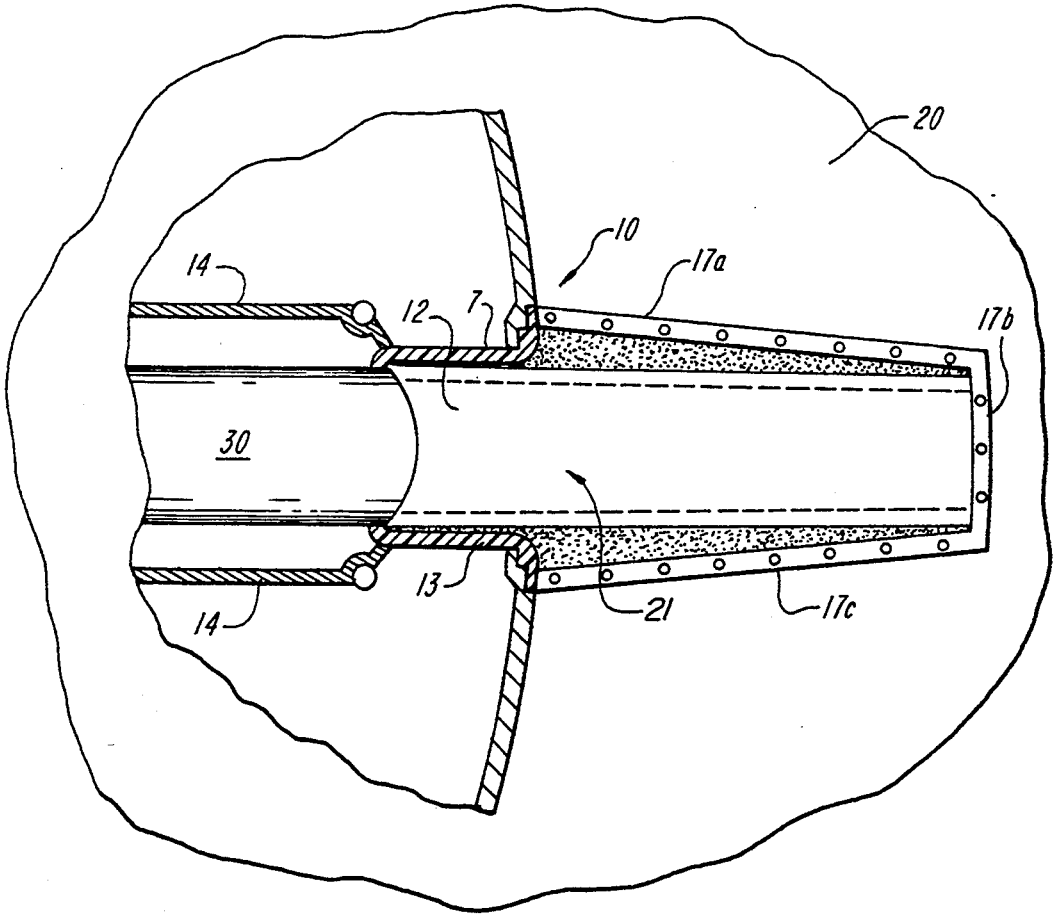
FIG. 1B is a cut-away side view of a submarine hull having an elastomeric shutter mechanism according to the present invention in an opened position.

As shown in FIGS. 1A and 1B, the flexible shutter mechanism 10 includes a single, unitary, retractable shutter member 12 which is made of an elastomeric material. The shutter member 12 can be molded from numerous elastomers, such as natural rubber, synthetic rubber, neoprene and polyurethane. Attached portions 17*a*–17*c* of the shutter member 12 are fastened to the submarine hull 20 or other such vessel, while unattached portion 7 of the shutter member 12 is left unattached so that the shutter member can be retracted or opened. When retracted, an opening 15 is formed, and a weapon or other piece of equipment 30 can be ejected or retrieved through the opening, as shown in FIG. 1B.

The single, unitary, retractable shutter member 12 can be fastened to submarine hull 20 by bolting directly through the elastomeric shutter member 12 to the hull 20 of the submarine. Alternatively, edge frames (not shown) can be molded into the elastomeric shutter member 12, and the edge frames then bolted to the hull 20. In the preferred embodiment, the single, unitary, retractable shutter member 12 has a polygonal shape, such as the rectangular shaped shutter member 12 shown in FIGS. 1A and 1B. While only a rectangular shaped shutter member is shown, other possible shapes are contemplated using the same flexible retractable shutter concept.

In the preferred embodiment, the elastomeric shutter member 12 is sealed against the hull 20 around the opening. In the preferred embodiment, the elastomeric shutter member 12 is maintained in a closed position (FIG. 1A) by latching along the unattached portion and further sealed by a pressure differential on the first and second surfaces of the shutter member. When released from its retracted position, the elastomeric shutter member 12 expands out from the hull and remains closed.

Figure 2A:
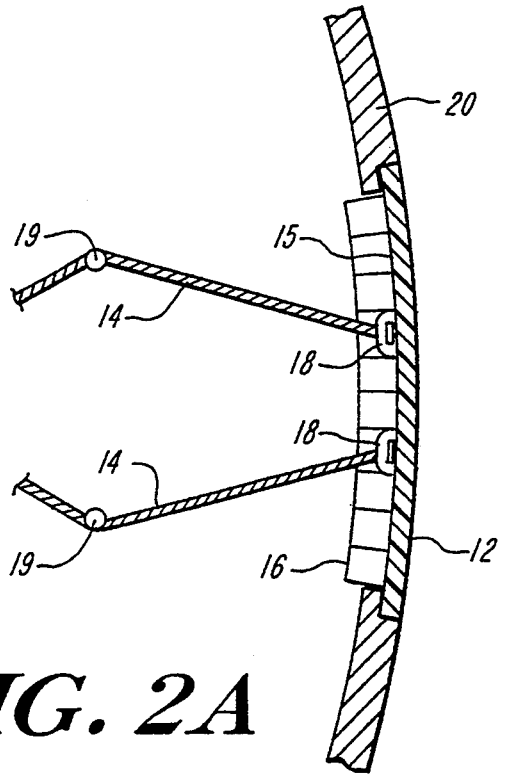
FIG. 2A is a cross sectional view of an elastomeric shutter mechanism in a closed position according to one embodiment of the present invention having split ribs.
Figure 2B:
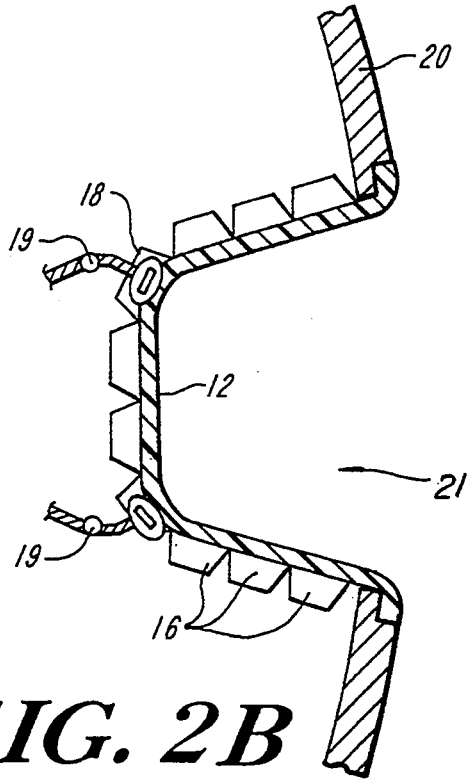
FIG. 2B is a cross sectional view of the elastomeric shutter mechanism of FIG. 2A in an opened position.

The flexible shutter mechanism further includes a shutter retraction system for retracting the shutter member 12 from the closed position (FIG. 1A) to the open position (FIG. 1B). In the preferred embodiment, the retraction mechanism comprises a cable retraction system. The cable retraction system includes cables 14 which are attached to an internal frame 18 on the inside surface 15 of the shutter member 12, as shown in FIGS. 2A and 2B. When a force is applied to the cables 14, the elastomeric shutter member 12 retracts to form the opening 21, as shown in FIG. 2B. The cable retraction system further includes mechanical stops 19 mounted inside of the submarine hull for abutting the shutter member 12 when retracted to the open position. The elastic shutter member will return to its closed shape by internal elastic forces once the shutter retraction mechanism is released. While the embodiment shown in FIG. 2A include two cables 14, the flexible shutter mechanism can have different numbers of cables attached to the inside surface of the shutter member 12. This allows the deformation shape of the elastomeric shutter member 12 to be designed to provide for retraction into a convenient shape for the opening which will provide for a hydrodynamic advantage or to provide for proper interface with a UUV. Alternatively, the retraction mechanisms can include a mechanical linkage system.

When the flexible shutter-mechanism is used on a section of the submarine hull where substantial hydrodynamic forces will cause significant distortion of shutter member 12, pressure differences can be used to maintain the shutter member 12 in a closed position, and a structure is employed to resist the expansion of the elastomeric shutter member 12 when these forces and pressure cause the shutter member 12 to expand out from the hull. In the preferred embodiment, split ribs 16 are molded into the inside surface 15 of elastomeric shutter member 12 for resisting the expansion of the shutter member 12 when in the closed position (FIG. 2A) without affecting the inward motion of the shutter member 12 (FIG. 2B). The split rib structures allow the elastomeric shutter member 12 to be designed to be flush with the submarine hull when in the closed position, as shown in FIG. 2A.

Figure 3:
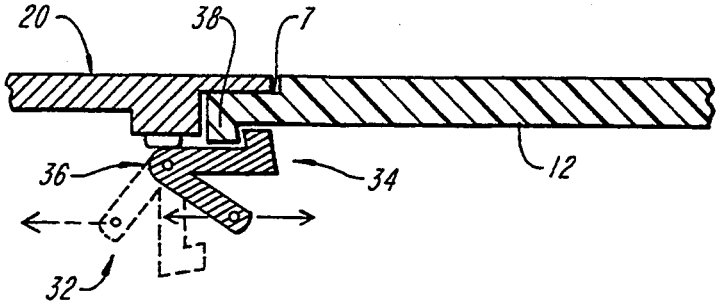
FIG. 3 is a cross sectional view of the elastomeric shutter mechanism of FIG. 1A taken along line 3—3 showing the latching mechanism.

Referring now to FIG. 3, there is shown a cross-sectional view of the elastomeric shutter mechanism of FIG. 1A taken along line 3—3 showing a latching mechanism 32. Latching mechanism 32 includes a latch 34 and a hinge pin 36. A latching ridge 38 is disposed on the interior surface of edge 7. When shutter 12 is in the closed position, edge 7 of shutter contacts hull 20, and latch 34 can be pivoted on hinge pin 36 to engage latching ridge 38. When opening of shutter 12 is desired, latch 34 can be pivoted away from engagement with latching ridge 38. Movement of latch 34 can be accomplished by any well known means such as a mechanical linkage, a hydraulic actuator, or a solenoid. In an alternate embodiment of this invention, latching mechanism 32 is omitted, and shutter 12 is maintained in position by hydrodynamic forces.

The elastomeric shutter member has many advantages in the fabrication and installation of the shutter mechanism. The elastomeric shutter member 12 can be fabricated at a much lower cost using autoclave forming methods, such as those currently used for surface ship sonar dome boots. Also, installation costs are greatly reduced because the shutter member 12 is bolted along three sides and very little alignment is required. Finally, the cable retraction mechanism with mechanical stops is much simpler than the multi-link system currently used on submarines.

The elastomeric shutter mechanism also has several advantages in its operation. First, the shutter member 12 is sealed around the edges and will reduce flow-induced noise caused by leakage through the gaps around shutter doors. Second, the compliant elastomeric material of the shutter member eliminates rattles, greatly reduces the noise of vehicle impacts and reduces damage to the vehicles which are ejected or recovered through the opening. Finally, the shutter member 12 can be designed to deform to a convenient shape which could provide pressure recovery and would be very desirable when used as a fairing hull closure for an ejection pump inlet.

In light of the above, it is therefore understood that within the scope of the appended claims, the invention may be practiced otherwise than as specifically described.

What is claimed is:

1. A flexible shutter mechanism for opening and closing a passageway in a vessel having a wall, said flexible shutter device comprising:

a single, unitary, retractable elastomeric shutter member having an inside surface and an outside surface and having a first edge region attached to said wall of said vessel around a first substantial portion of said passageway and a second edge region unattached to said passageway in said wall, said single, unitary, retractable, elastomeric shutter member moveable between a closed position wherein said second unattached edge region of said single, unitary, retractable, elastomeric shutter member is abutting a portion of said wall around said opening opposite said second unattached edge region, and an open position wherein said second unattached edge region of said single, unitary, retractable elastomeric shutter member is retracted away from a portion of said wall around said opening opposite said second, unattached edge region thereby exposing said passageway; and an elastomeric shutter member retractor, attached to said inside surface of said single, unitary, retractable, elastomeric shutter member, for effecting movement of said single, unitary, retractable, elastomeric member between said closed position and said open position, exposing said passageway.

2. The flexible shutter mechanism of claim 1 wherein said single, unitary, retractable, elastomeric shutter member has a substantially polygonal shape with at least three sides, and wherein one of said sides forms said unattached second edge region, while the remaining of said at least three sides form said first edge region attached to said wall around said passageway.

3. The flexible shutter mechanism of claim 1 wherein said elastomeric material includes at least one material selected from the group consisting of natural rubber, synthetic rubber, neoprene and polyurethane.

4. The flexible shutter mechanism of claim 1 wherein said elastomeric shutter member retractor comprises at least one cable attached to said inside surface of said single, unitary, retractable, elastomeric shutter member, and at least one mechanical stop mounted inside of said vessel for abutting with said single, unitary, retractable elastomeric shutter member when said elastomeric shutter member is retracted to said open position by a force applied to said at least one cable.

5. The flexible shutter mechanism of claim 1 wherein said single, unitary, retractable elastomeric shutter member is maintained in said closed position by a pressure differential between said inside surface and said outside surface of said single, unitary, retractable elastomeric shutter member.

6. The flexible shutter mechanism of claim 5 further comprising a plurality of ribs on one of said inside surface and said outside surface, for resisting expansion of said single, unitary, retractable elastomeric shutter member when said pressure differential maintains said single, unitary, retractable elastomeric shutter member in said closed position, and wherein said single, unitary, retractable elastomeric shutter member conforms generally to the shape of said wall of said vessel when in said closed position.

7. The flexible shutter mechanism of claim 1 further comprising a latching mechanism disposed on said vessel, said latching mechanism being positionable to a first position wherein said latching mechanism engages said shutter member to maintain said shutter member in abutment with said wall, and said latching mechanism being positionable to a second position wherein said latching mechanism is disengaged from said shutter member allowing said shutter member to move to an open position.

8. The flexible shutter mechanism of claim 7 further comprising a plurality of ribs on one of said inside surface and said outside surface, for resisting expansion of said single, unitary, retractable elastomeric shutter member when said pressure differential maintains said single, unitary, retractable elastomeric shutter member in said closed position, and wherein said single, unitary, retractable elastomeric shutter member conforms generally to the shape of said wall of said vessel when in said closed position.

9. A flexible shutter mechanism for opening and closing a passageway in an underwater vessel having an opening in a hull, said flexible shutter device comprising:

a single, unitary, retractable elastomeric shutter member having an inside surface and an outside surface and having a first edge region attached and sealed to said hull of said underwater vessel around a first substantial portion of said passageway and a second edge region unattached to said passageway, said single, unitary, retractable shutter member moveable between a closed position wherein said second unattached edge region of said elastomeric shutter member is sealed against a portion of said hull around said opening opposite said second unattached edge region and an open position wherein said second unattached edge region of said single, unitary, retractable shutter member is retracted away from an unattached portion of said hull around said opening opposite said second, unattached edge region exposing said passageway, wherein said single, unitary, retractable shutter member is maintained in said closed position by a pressure differential between said inside surface and said outside surface of said single, unitary, retractable shutter member;

an elastomeric shutter member retractor, attached to said inside surface of said single, unitary, retractable elastomeric shutter member for effecting movement of said single, unitary, retractable elastomeric shutter member between said closed position and said open position, exposing said passageway; and expansion resisting members, disposed on said inside surface of said single, unitary, retractable elastomeric shutter member for resisting expansion of said single, unitary, retractable shutter member when in said closed position so that said single, unitary, retractable shutter member conforms with the shape of said hull.

10. The flexible shutter mechanism of claim 9 further comprising a latching mechanism disposed on said vessel, said latching mechanism being positionable to a first position wherein said latching mechanism engages said shutter member to maintain said shutter member sealed to said hull, and said latching mechanism being positionable to a second position wherein said latching mechanism is disengaged from said shutter member allowing said shutter member to move to an open position.

11. The flexible shutter mechanism of claim 9 wherein said expansion resisting members comprise a plurality of split ribs located on said inside surface of said single, unitary, retractable shutter member.

* * * * *